US007363845B2

(12) United States Patent
McClellan

(10) Patent No.: US 7,363,845 B2
(45) Date of Patent: Apr. 29, 2008

(54) CONCEALABLE SPEED LOADER FOR FIREARMS AND METHOD FOR LOADING A FIREARM

(76) Inventor: W. Thomas McClellan, P.O. Box 460460, Fort Lauderdale, FL (US) 33346

( * ) Notice: Subject to any disclaimer, the term of this patent is extended or adjusted under 35 U.S.C. 154(b) by 8 days.

(21) Appl. No.: 11/218,003

(22) Filed: Sep. 1, 2005

(65) Prior Publication Data

US 2007/0044363 A1 Mar. 1, 2007

(51) Int. Cl.
*F42B 39/08* (2006.01)

(52) U.S. Cl. ..... 89/35.01; 42/89

(58) Field of Classification Search ..... 89/35.01, 89/35.02, 34; 42/89
See application file for complete search history.

(56) References Cited

U.S. PATENT DOCUMENTS 891,374 A * 6/1908 Ruszitszka ..... 89/35.02
3,213,559 A * 10/1965 Matich ..... 42/89
3,706,260 A * 12/1972 Rausing ..... 89/35.01
4,325,198 A * 4/1982 Muck et al. ..... 42/89
4,614,053 A * 9/1986 Billman ..... 42/89
4,862,622 A 9/1989 Goyanes

* cited by examiner

*Primary Examiner*—Stephen M Johnson
(74) *Attorney, Agent, or Firm*—Laurence A. Greenberg; Werner H. Stemer; Ralph E. Locher

(57) ABSTRACT

A concealable speed loader for firearms includes a flexible, one-piece body having a flat open condition, a closed annular condition, two ends and a given width. The body has grasping chambers for receiving cartridges with a length substantially greater than the given width, causing part of the length of the cartridges to protrude from the body in both the open and the closed conditions. A locking latch latches the two ends of the body in the closed condition for placement above a cylinder of a firearm with the cartridges protruding into chambers of the cylinder. The locking latch has a knob to be pulled for manually removing the body and releasing the cartridges in turn as the cylinder rotates and the cartridges drop fully into the chambers of the cylinder. A method for loading a firearm is also provided.

16 Claims, 15 Drawing Sheets

CONCEALABLE SPEED LOADER FOR FIREARMS AND METHOD FOR LOADING A FIREARM

BACKGROUND OF THE INVENTION

1. Field of the Invention

The invention relates to a speed loader for firearms and to a method for loading a firearm.

2. Description of the Related Art

Firearm loaders are solid, round, bulky metal cylinders with complex mechanical release mechanisms. The fixed circular configuration allows mating with the opened revolver cylinder for loading. However, the cylinder chargers or speed loaders are difficult to use and the fixed round and tall configuration makes it impossible to conceal in normal street garments.

Conventional non-round firearm loaders are complex hinged metal devices that do not lock in discrete matching circles, nor discharge the rounds cleanly and are difficult to use and unreliable. Such a device is disclosed in U.S. Pat. No. 4,862,622.

SUMMARY OF THE INVENTION

It is accordingly an object of the invention to provide a concealable speed loader for firearms and a method for loading a firearm, which overcome the hereinafore-mentioned disadvantages of the heretofore-known devices and methods of this general type and in which the speed loader may be stored flat and concealed even in a loaded condition, yet may be secured in an annular shape when in a closed condition for loading the firearm.

With the foregoing and other objects in view there is provided, in accordance with the invention, a concealable speed loader for firearms. The speed loader comprises a flexible body having a flat open condition, a closed annular condition and a given width. The body has grasping chambers for receiving cartridges with a length substantially greater than the given width, causing part of the length of the cartridges to protrude from the body in both the open and the closed conditions. A locking latch latches the body in the closed condition for placement above a cylinder of a firearm with the cartridges protruding from the grasping chambers into chambers of the cylinder. The locking latch has a knob to be pulled for manually removing the body and releasing the cartridges in turn as the cylinder rotates and the cartridges drop fully into the chambers of the cylinder. In the open condition, the speed loader is flat enough to be concealed within the clothing of the user of the device and yet is easily latched into the closed position for loading the cartridges into the cylinder of the firearm.

In accordance with another feature of the invention, the given width is approximately one-half of the length of the cartridges. It is preferable, although not absolutely necessary, for half of the length of the cartridges to protrude from the speed loader.

In accordance with a further feature of the invention, the body has fingers with side walls and shoulders. Pairs of the side walls define the grasping chambers and pairs of the shoulders abut each other in the closed condition. This provides secure grasping of the cartridges, since as one side of the fingers abut each other, the other side holds the cartridges with tension.

In accordance with an added feature of the invention, the body has hinges located between the grasping chambers.

The so-called "live" hinges guide and maintain the cartridges in place and prevent misalignment. The hinges are thinned sections of the body.

In accordance with an additional feature of the invention, the knob of the locking latch is disposed at one end of the body. The locking latch has a protrusion disposed at another end of the body. The protrusion or post engages in a recess formed in the vicinity of the knob, in the closed condition. This structure provides secure latching of the body in the closed position, yet the latch is easily unlatched and the cartridges are inserted into the chambers of the firearm cylinder, in one movement.

In accordance with yet another feature of the invention, the body, in the closed condition, has an outer contour matching an outer contour of the cylinder of the firearm. This feature facilitates placement of the speed loader in the closed condition in the correct position above the cylinder of the firearm for loading.

In accordance with yet a further feature of the invention, the body is formed in one piece, which makes it particularly easy and inexpensive to manufacture and use. With the objects of the invention in view, there is also provided a method for loading a firearm. The method comprises providing a flexible body having a flat open condition, a closed annular condition, grasping chambers and a knob. Cartridges are loaded into the grasping chambers of the body in the flat open condition, with the cartridges protruding from the grasping chambers. The body is placed and latched in the closed condition with the cartridges protruding from the grasping chambers. The body, in the closed condition, is placed above a cylinder of a firearm with the cartridges protruding into chambers of the cylinder. The knob is pulled to unlatch the body and release the cartridges in turn as the cylinder rotates and the cartridges drop fully into the chambers of the cylinder.

In accordance with another mode of the invention, the body has a given width, and the cartridges have a length substantially greater than the given width, preferably but not necessarily equal to twice the given width, so that enough of the cartridges protrudes from the speed loader to ensure secure entry into the chambers of the firearm cylinder before final loading.

In accordance with a further mode of the invention, the body includes a locking latch having the knob. The knob of the locking latch is disposed at one end of the body and the locking latch has a protrusion disposed at another end of the body. The step of latching the body in the closed condition is carried out by engaging the protrusion in a recess formed in the vicinity of the knob. Thus, a secure latching is provided, yet the latching can be easily undone for removing the speed loader and completing the loading of the cartridges into the firearm cylinder.

In accordance with an added mode of the invention, hinges located in the body between the grasping chambers guide and maintain the cartridges in place and prevent misalignment. The hinges are thinned sections of the body, so that no complicated hinge structure is needed.

In accordance with an additional mode of the invention, movement of the body into the closed condition is limited by abutting pairs of shoulders of the body against each other. This tensions the cartridges in the grasping chambers.

In accordance with yet another mode of the invention, the body, in the closed condition, has an outer contour matching an outer contour of the cylinder of the firearm. Thus, it is easy to match the shape of the speed loader to the shape of the cylinder to prepare for final loading of the cartridges into the firearm cylinder.

In accordance with a concomitant mode of the invention, the body is formed in one easy and inexpensive to manufacture and use flexible piece of light-weight material, such as plastic.

Other features which are considered as characteristic for the invention are set forth in the appended claims.

Although the invention is illustrated and described herein as embodied in a concealable speed loader for firearms and a method for loading a firearm, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of the specific embodiment when read in connection with the accompanying drawings.

DESCRIPTION OF THE PREFERRED EMBODIMENTS

Figure 1:
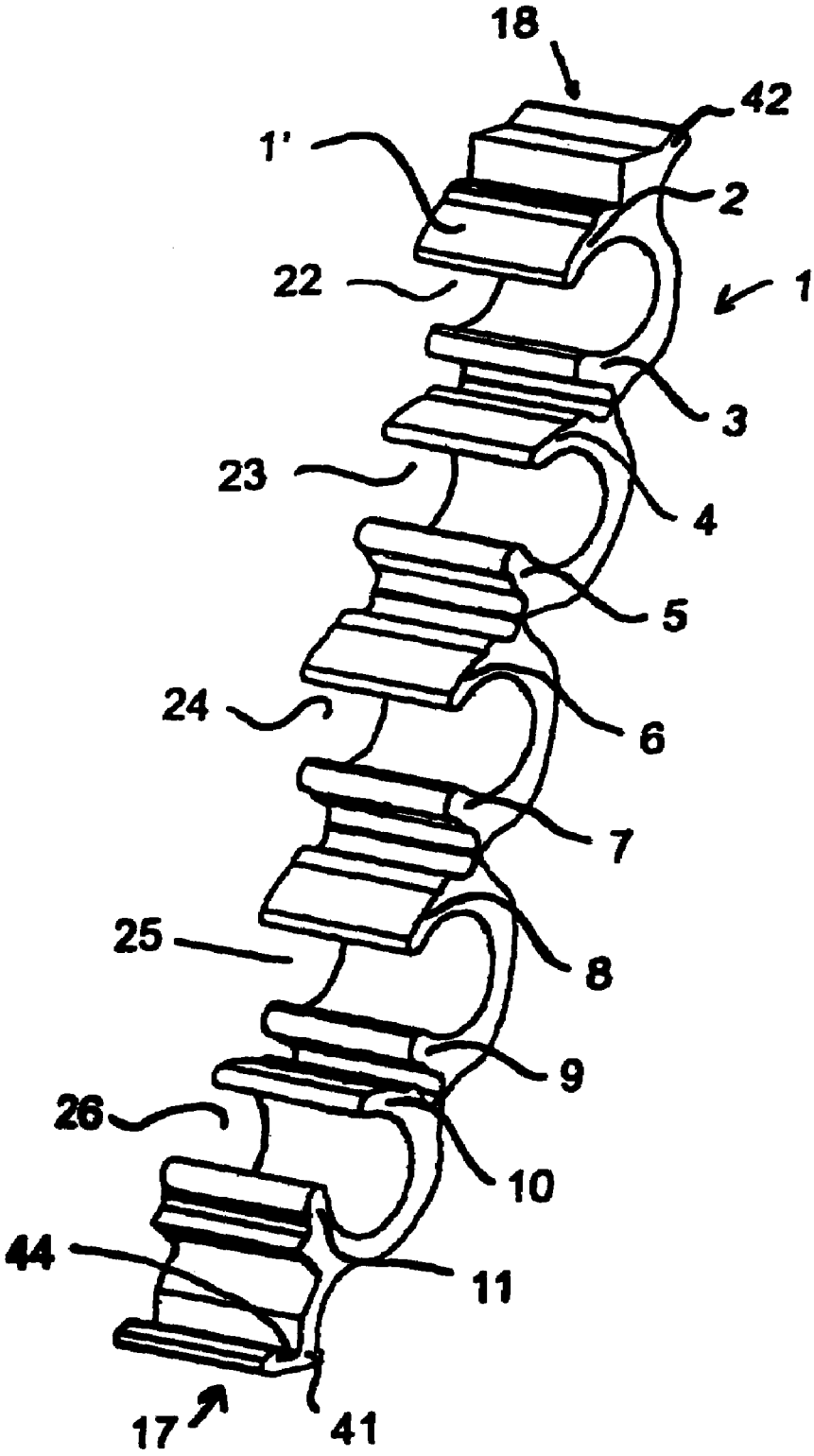
FIG. 1 is a diagrammatic, top-perspective view of a concealable speed loader for firearms according to the invention, in an open and unloaded condition.
Figure 2:
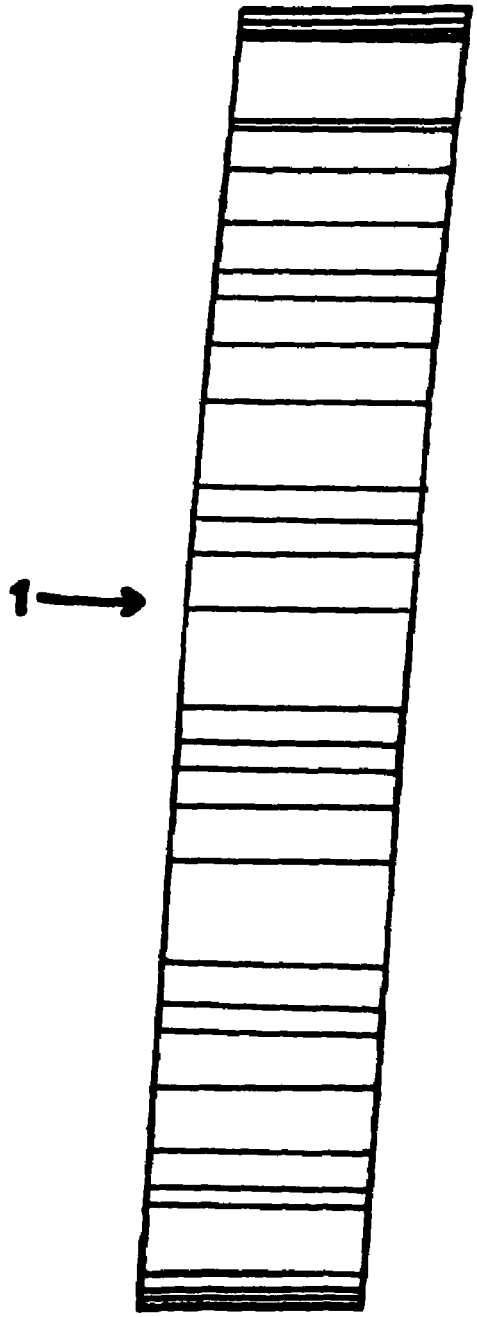
FIG. 2 is a rear-elevational view of the open and unloaded concealable speed loader according to FIG. 1.
Figure 3:
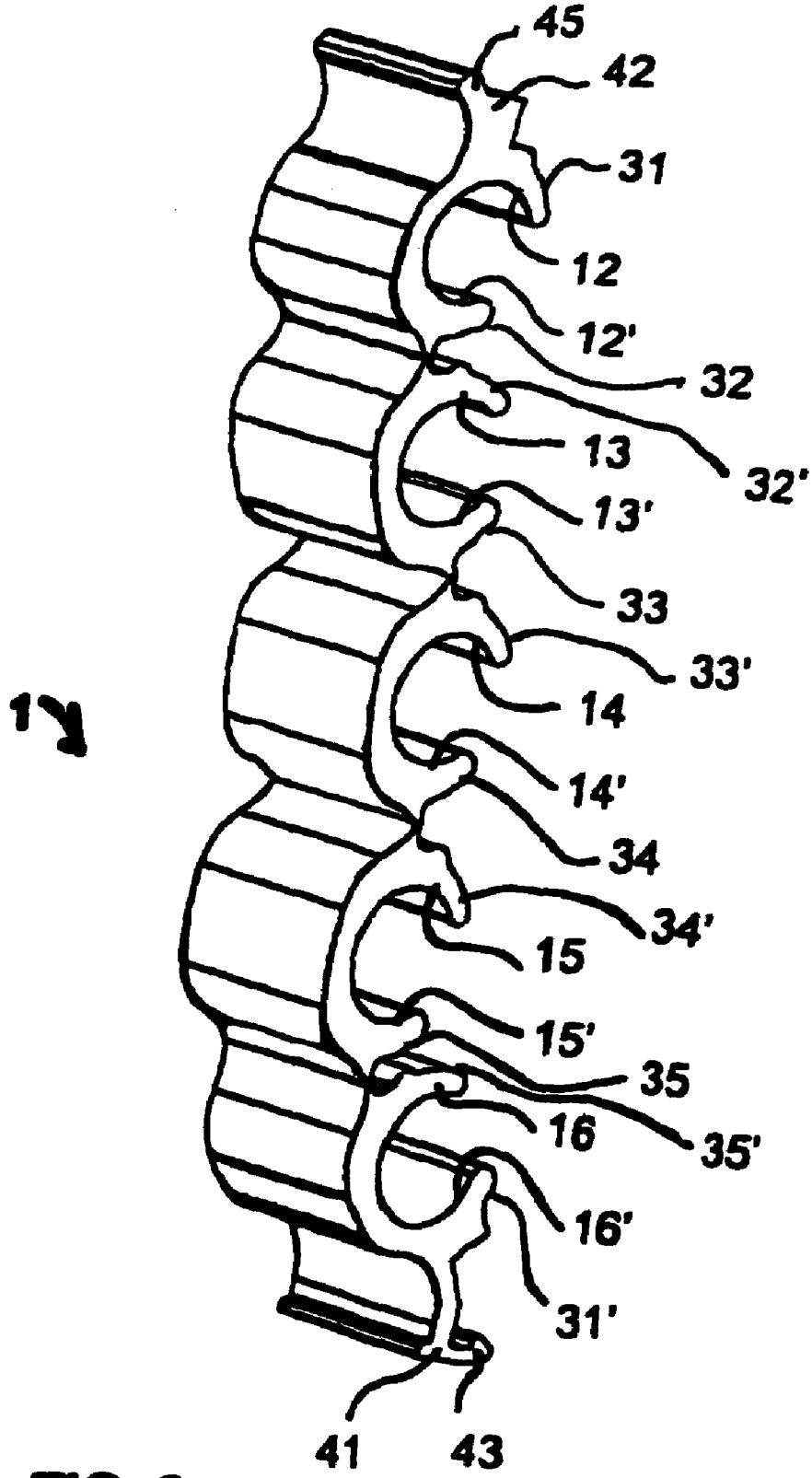
FIG. 3 is a bottom-perspective view of the open and unloaded concealable speed loader according to FIG. 1.

Referring now to the figures of the drawings in detail and first, particularly, to FIGS. 1, 2 and 3 thereof, there is seen a one-piece, concealable, firearm cylinder charger or speed loader 1 for firearms, in respective top-perspective, rear-elevational and bottom-perspective views. The speed loader 1, which is shown in an open and unloaded condition, has a body 1' with ends 17, 18. The body 1' may be formed of any suitable material which combines strength and pliability.

The speed loader 1 has fingers 3-11 shown in FIG. 1, which serve a dual purpose. The fingers 3-11 provide respective pairs of side walls 12 and 12', 13 and 13', 14 and 14', 15 and 15', 16 and 16' that define grasping chambers 22, 23, 24, 24 and 26, each of which grasps a round, bullet or cartridge therein with tension for loading in a firearm. Although five grasping chambers 22-26 are shown, it is understood that the device may be sized to different diameter cylinders, different calibers and different round numbers. The fingers also have pairs of shoulders 31 and 31', 32 and 32', 33 and 33', 34 and 34', 35 and 35'. The shoulders of each pair abut each other when the speed loader 1 is in a closed condition.

Figure 4:
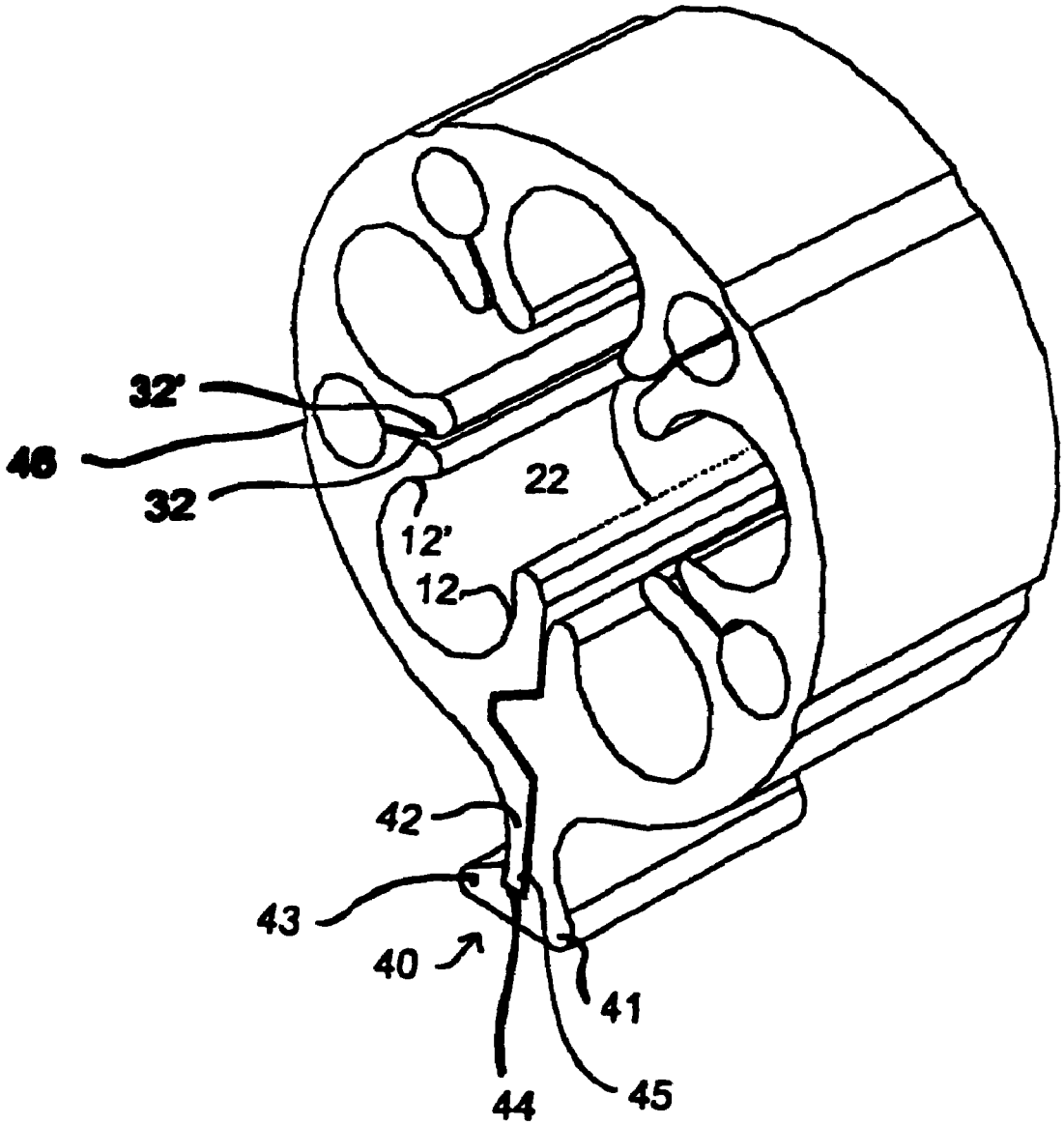
FIGS. 4 and 5 are respective top-perspective and top-plan views of the concealable speed loader in the closed but unloaded condition.
Figure 5:
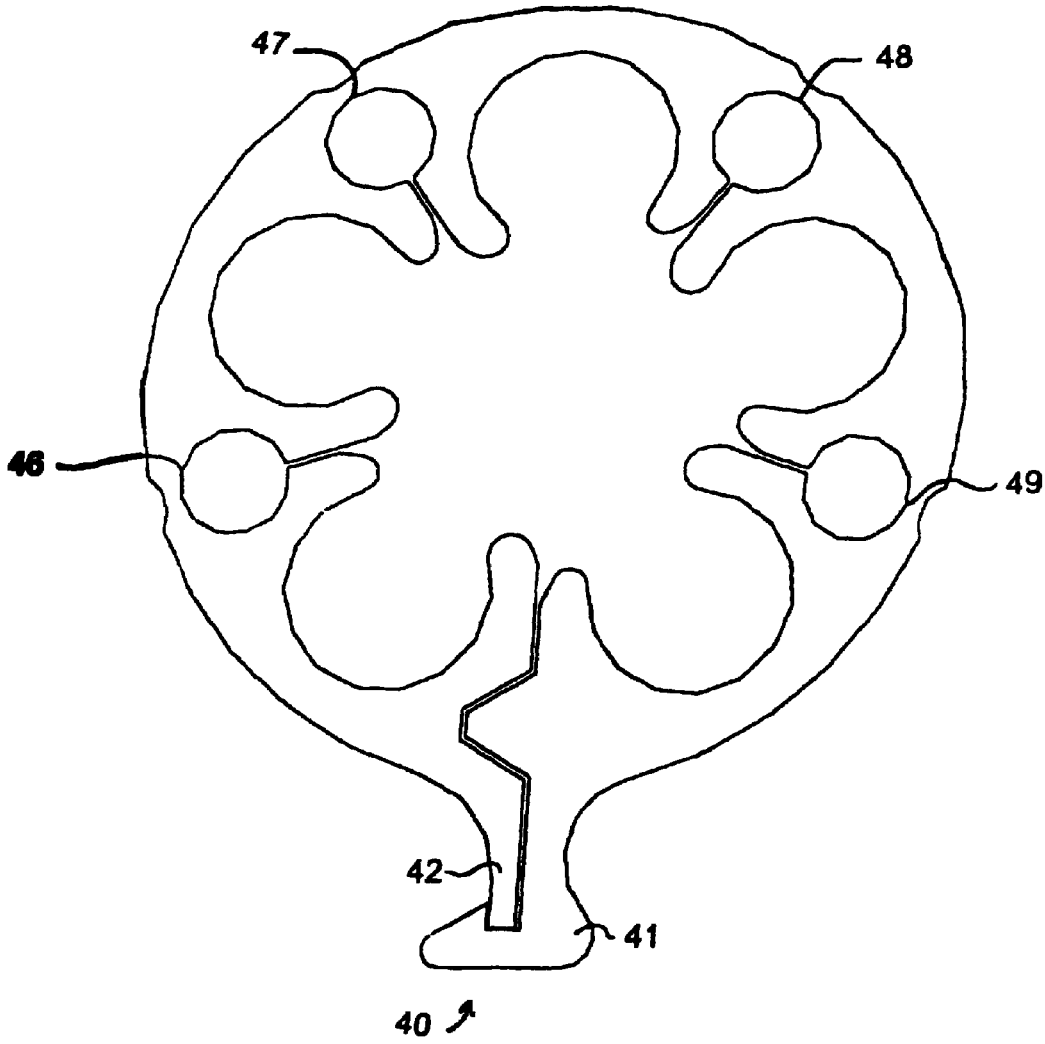

FIGS. 4 and 5 show the speed loader 1 in the closed, but still unloaded condition, making it possible to clearly see further details of the device. It may be seen that the side walls 12, 12' form the grasping chamber 22 and that the shoulders 32, 32' abut each other in the closed condition about a live hinge 46, which is a thinned section of the same material. A total of four live hinges 46-49 are located between the grasping chambers 22-26. The live hinges keep and guide the cartridges "in plane" and prevent misalignment.

A self-centering locking latch 40 is shown in FIGS. 1-5 as well. FIGS. 1-3 show parts 41, 42 of the locking latch 40 in an unlatched condition and FIGS. 4 and 5 show the parts of the locking latch in a latched condition forming an annular shape. The locking part 41, which is disposed at one end 17 of the body 1', has an asymmetrical knob or locking tab 43 and a recess 44. The locking part 42, which is disposed at another end 18 of the body 1', has a self-centering protrusion or post 45 which latches in the recess 44. Once mated, the asymmetric knob 43 is pulled to unlatch and open the loader.

Figure 6:
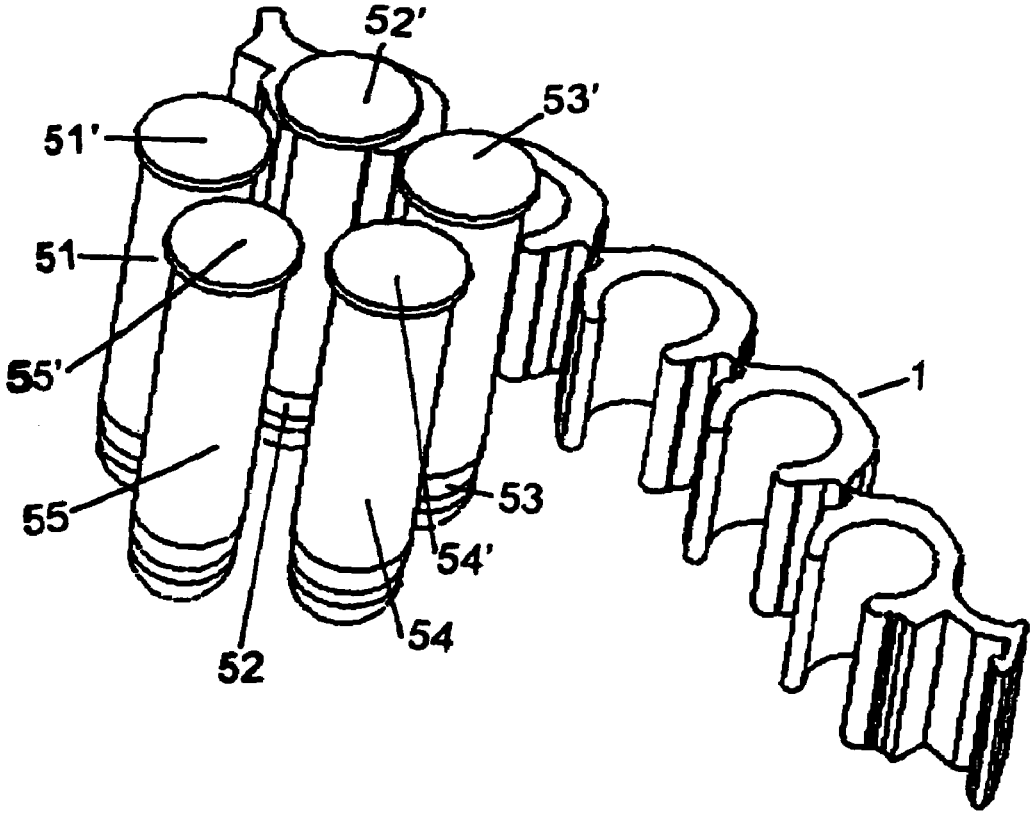
FIG. 6 is a top-perspective view of the concealable speed loader in a partly open and partly loaded condition.

FIG. 6 illustrates the speed loader 1 being partially loaded with cartridges, bullets or rounds 51-55. It may be seen that the cartridges 52 and 53 are each secured in a respective grasping chamber 22 and 23. It is also seen that the cartridges have base regions or heels 51'-55'. The cartridges 51-55 are disposed in a circle, in a position which they would assume for loading in a cylinder of a firearm.

Figure 7:
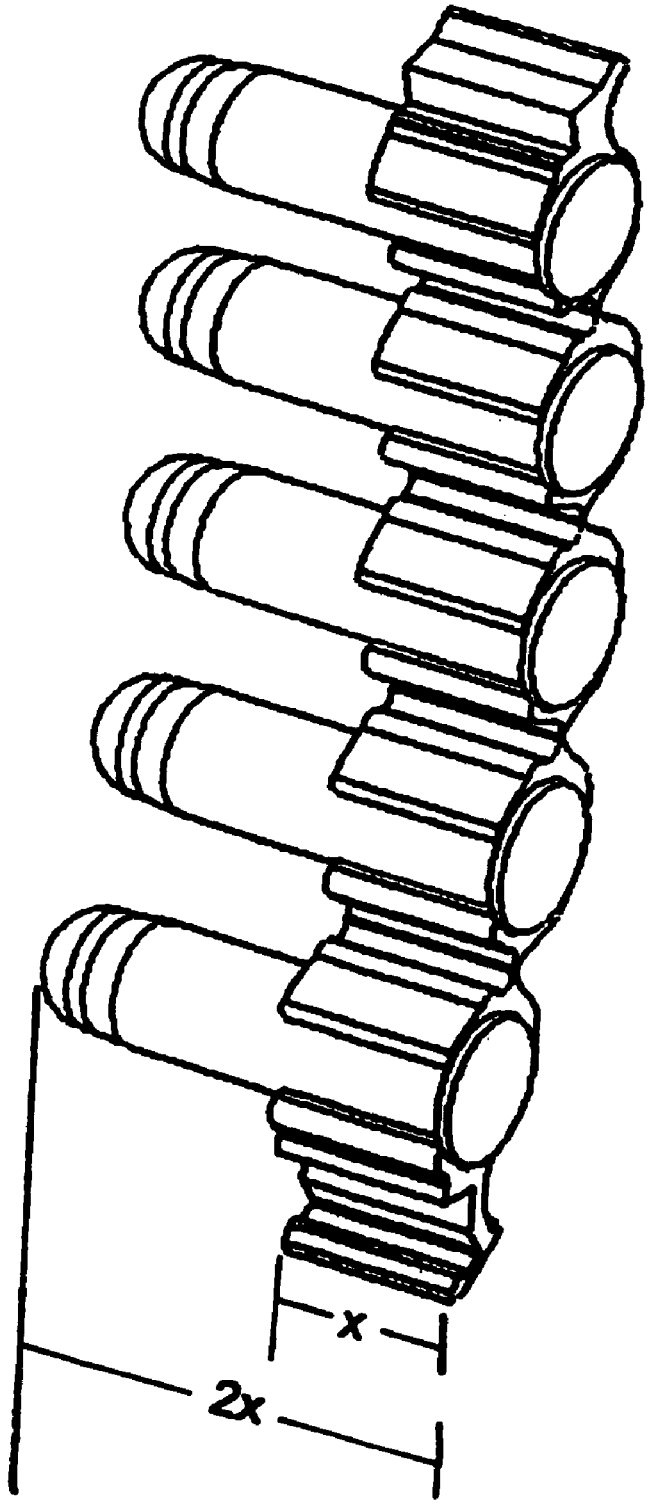
FIG. 7 is a top-perspective view of the concealable speed loader in the open but loaded condition.
Figure 8:
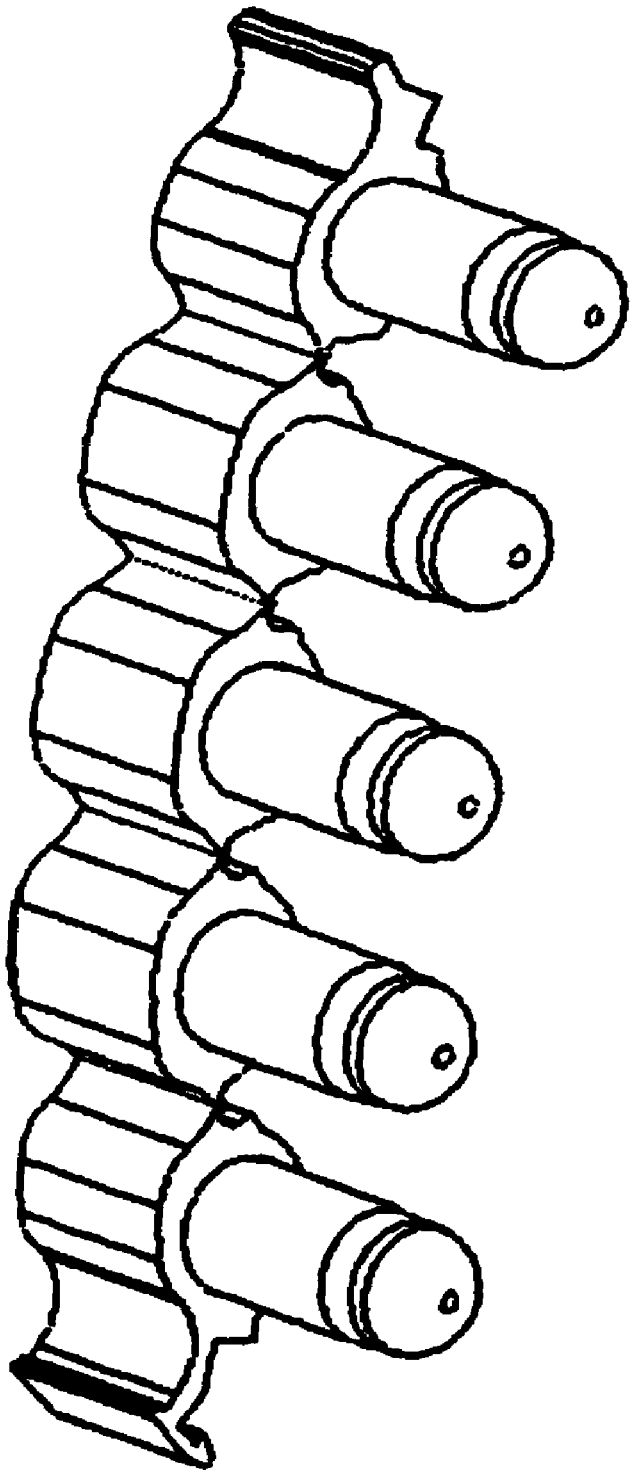
FIG. 8 is a bottom-perspective view of the concealable speed loader in the open but loaded condition.

FIGS. 7 and 8 show the speed loader 1 being fully loaded with the cartridges 51-55. It may be seen that the speed loader has a given width X, whereas the cartridges have a length 2X, so that ½ of the length of the cartridges lies within the grasping chambers and ½ of the length of the cartridges protrudes from the speed loader 1. The ends of the cartridges facing away from the base regions protrude from the speed loader 1. When open, the loaded device stores flat within a garment or may be mounted in a flat concealed holster disposed behind a belt clip. The open or flat configuration is quite simple to conceal because of its thinness and soft outline. It must be stated that the cartridges need not protrude by exactly ½ of their length out of the body of the speed loader. Rather, the length of the cartridges need only be substantially greater than the given width of the speed loader, which is a length and width permitting secure seating of the cartridges into the chambers of the cylinder of the firearm.

Figure 9:
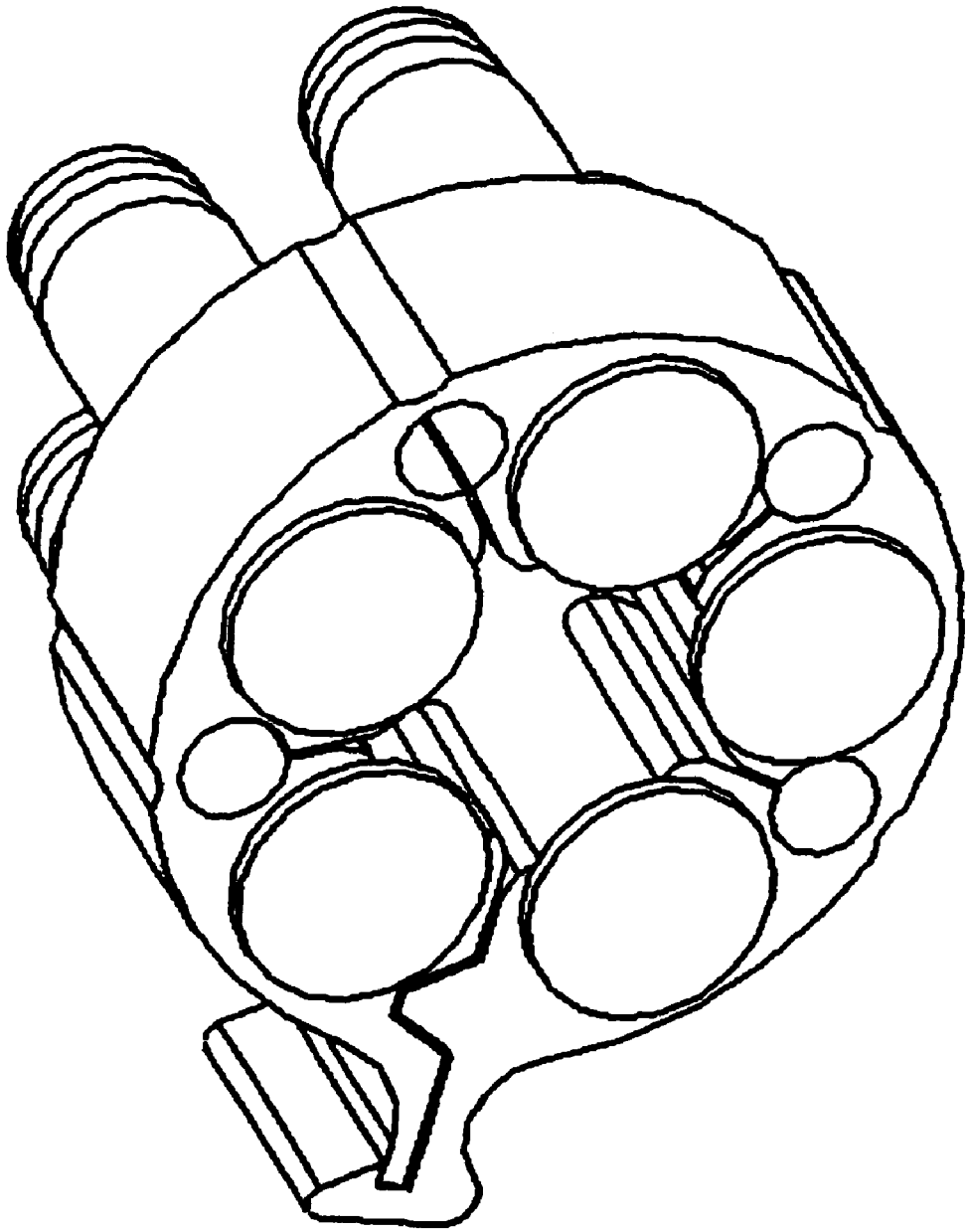
FIG. 9 is a top-perspective view of the concealable speed loader which is partially loaded with cartridges.
Figure 10:
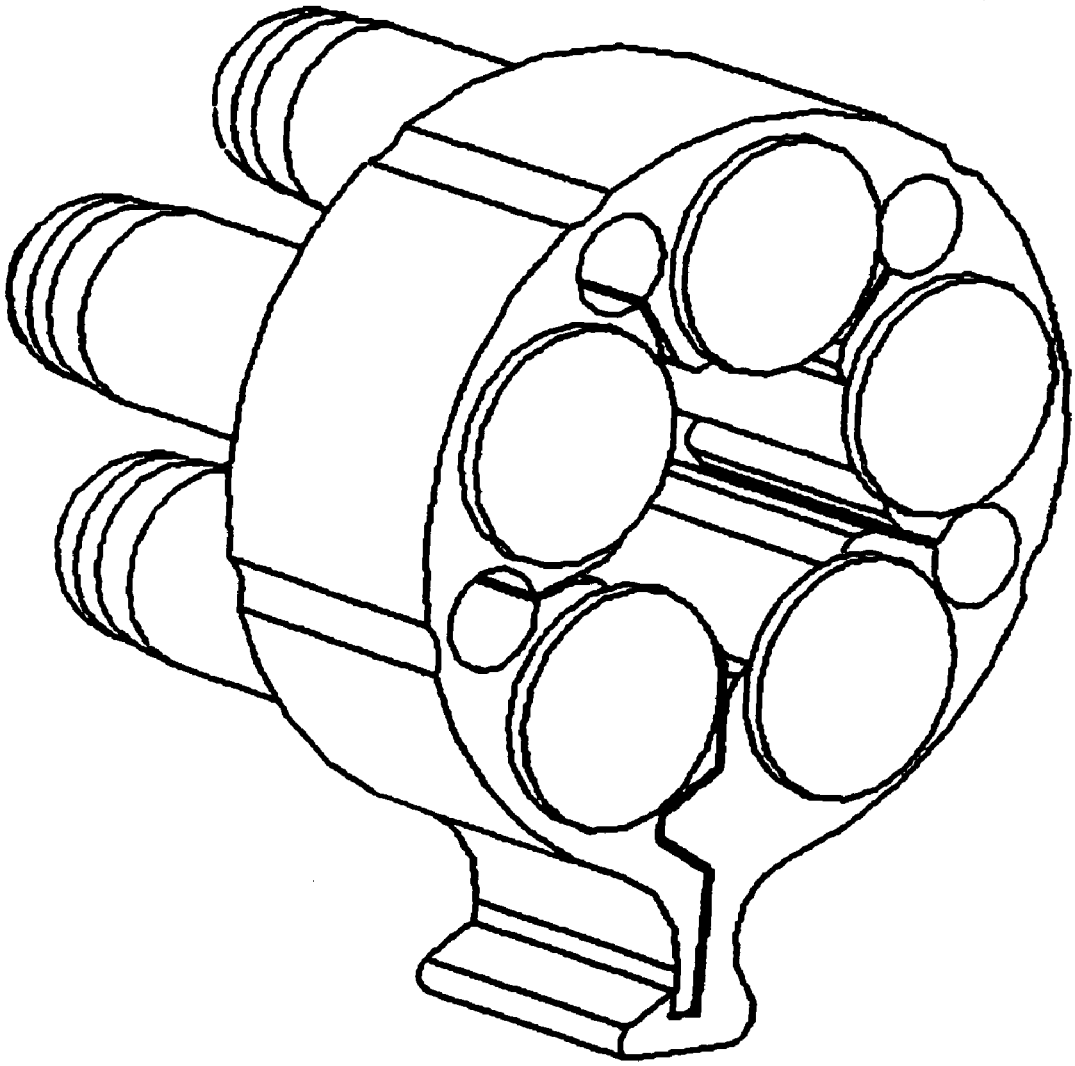
FIGS. 10 and 11 are respective top-perspective and side-perspective views of the concealable speed loader, fully loaded with cartridges.
Figure 11:
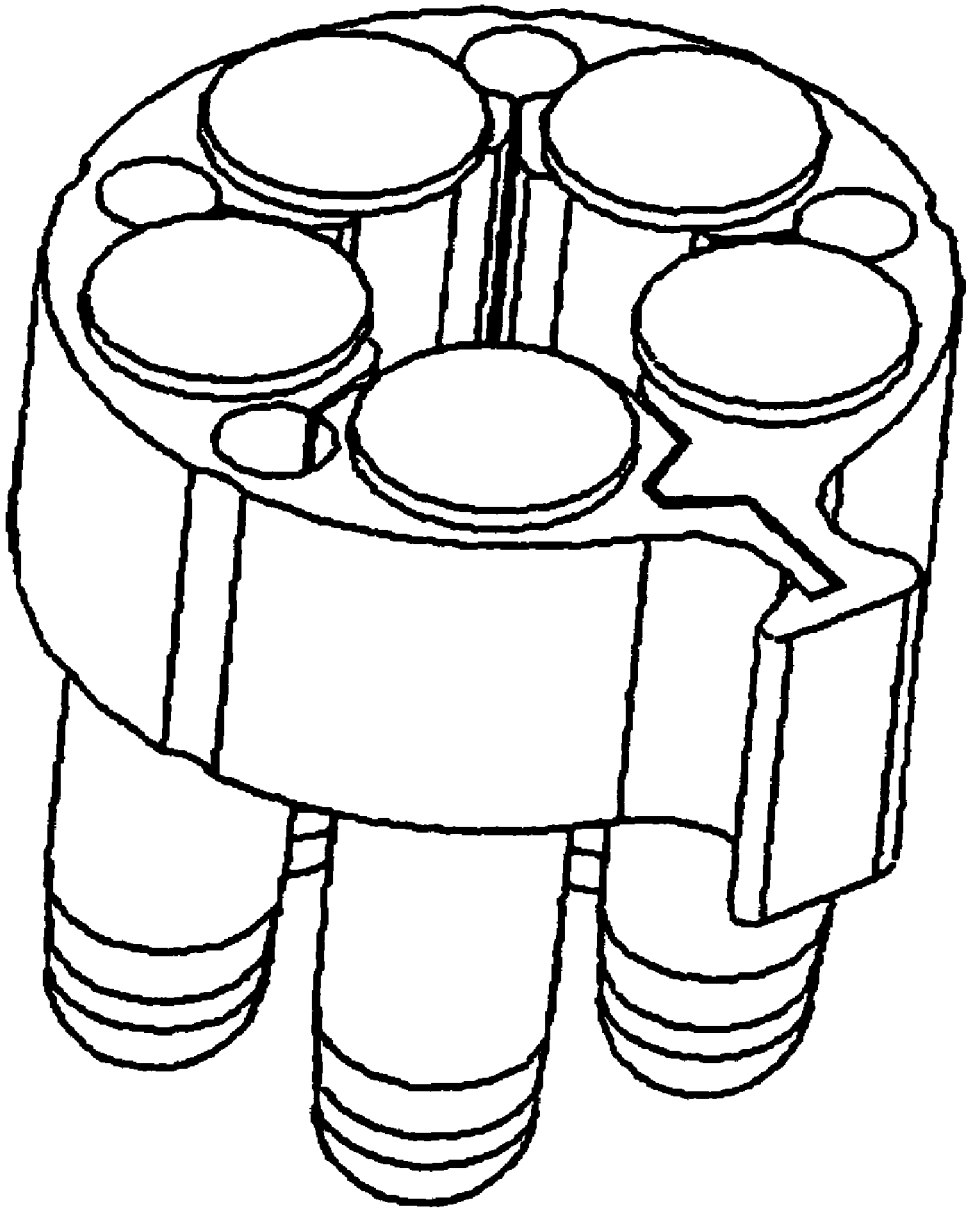
Figure 12:
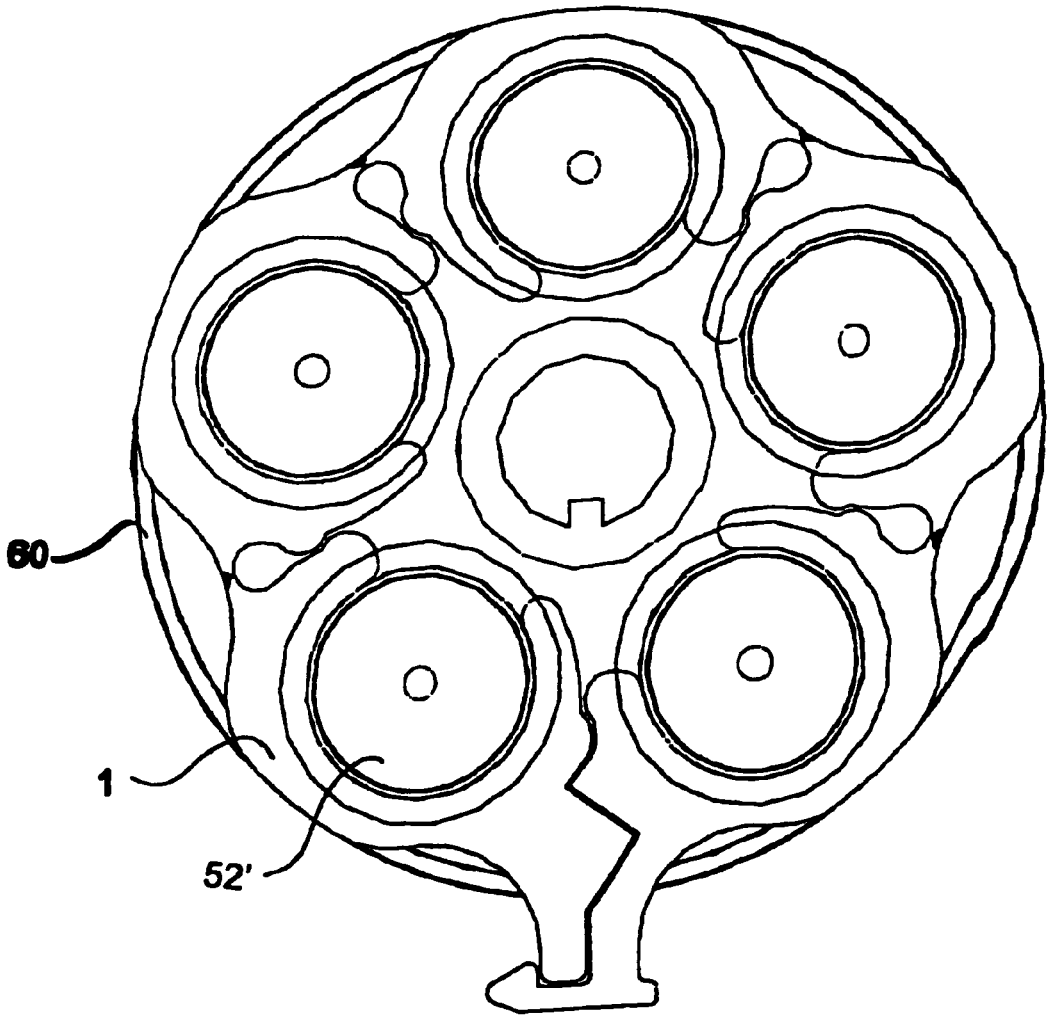
FIG. 12 is a top-plan view of the concealable speed loader in the closed but loaded condition, above a cylinder of a firearm.
Figure 13:
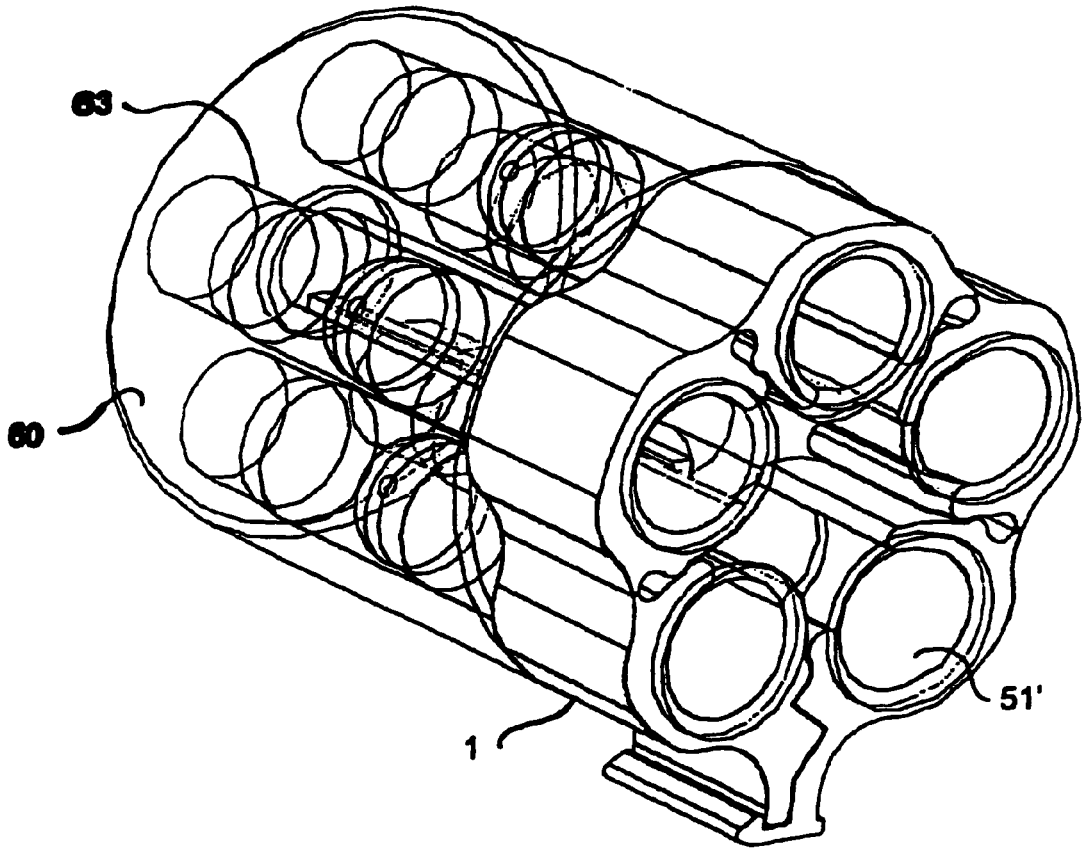
FIG. 13 is a top-perspective view of the concealable speed loader with cartridges extending into a cylinder of a firearm.

It may be seen from FIGS. 9, 10 and 11 that the speed loader 1 which is fully loaded with the cartridges 51-55 has been formed into a circle and that the locking latch 40 is in the latched position. In the position shown, the outer-most edges of the speed loader describe points along a perfect circle, which matches the outline of a cylinder of a firearm. According to FIG. 12, the speed loader which is fully loaded with the cartridges 51-55 has been placed above a cylinder 60 of a firearm. The ½ of the length of each of the cartridges which protrudes from the speed loader has been inserted into a respective chamber of the cylinder of the firearm. The protruding configuration allows matching of the exposed portions of the cartridges easily with the open cylinder. FIG. 13 diagrammatically illustrates the cartridges disposed with ½ of their length in the speed loader and the other ½ of their length in the chambers of the cylinder 60 of the firearm cylinder. Only one chamber 63 of the cylinder 60 has been indicated with a reference numeral in this case for clarity.

Figure 14:
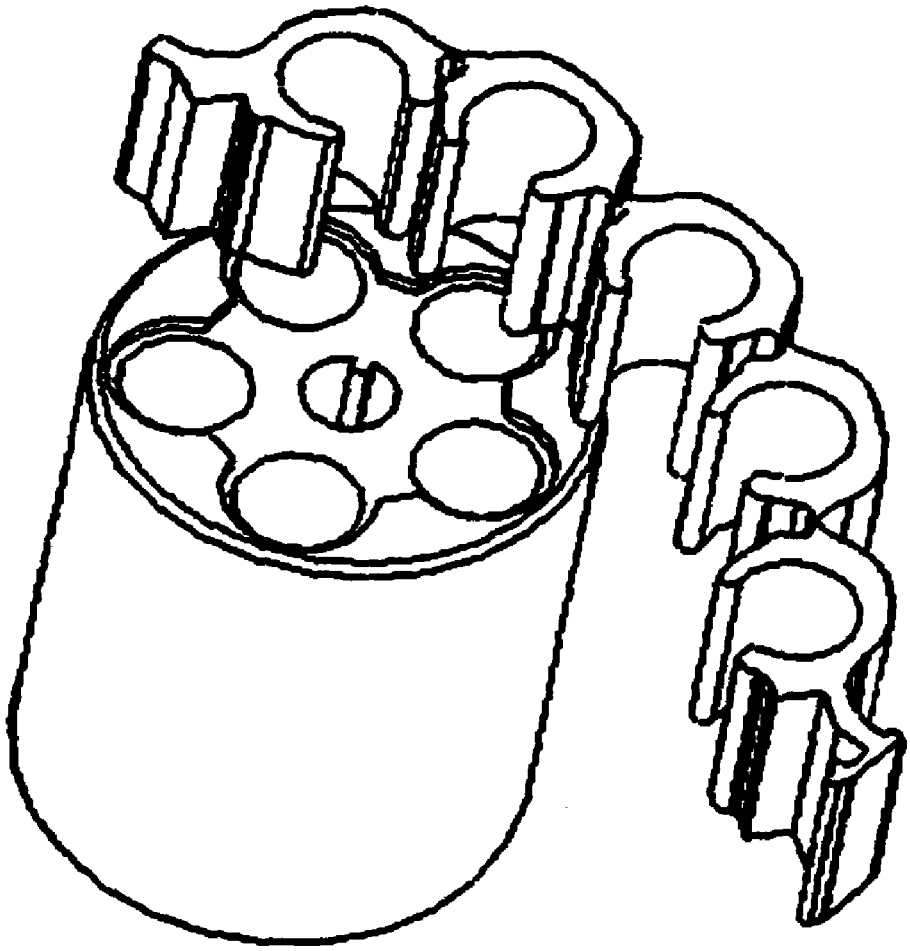
FIG. 14 is a top-perspective view of the concealable speed loader being partially removed from the cylinder of the firearm after loading cartridges into the cylinder.
Figure 15:
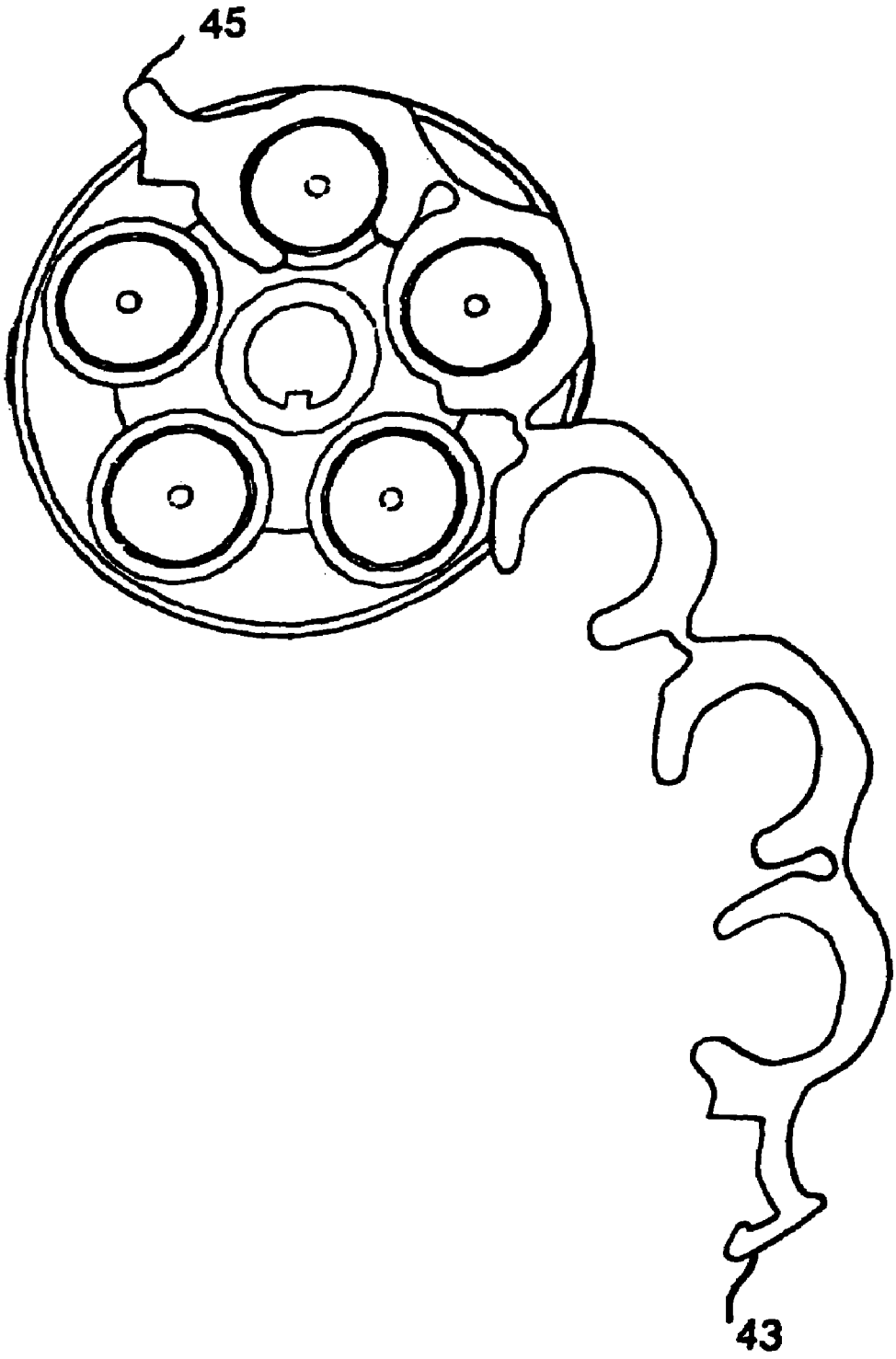
FIG. 15 is a top-plan view of the concealable speed loader and cylinder of the firearm in a condition similar to that shown in FIG. 14.

FIGS. 14 and 15 illustrate the operation of completing the loading of the chambers of the cylinder 60 of the firearm cylinder. When the cartridges are safely seated in the chambers of the firearm, with the muzzle down, the asymmetrical knob 43 is pulled, releasing the protrusion 45 and turning or spinning the cylinder as each cartridge is released in turn. As the knob is pulled farther, bullets release in order as the cylinder rotates. The flexible material of the speed loader body and unequal dimensioning of the asymmetrical knob 43 and the protrusion 45 ensure an even release of the rounds. The now-free cartridges free-fall and drop in place their remaining ½ length into the cylinder and the firearm is quickly and easily loaded. The cylinder is then snapped shut and the thus removed speed loader can be discarded.

I claim:

1. A one-piece concealable speed loader for firearms, comprising:

a one-piece flexible body having a flat open condition, a closed annular condition and a given width, said body having grasping chambers for receiving cartridges with a length substantially greater than said given width, causing part of the length of the cartridges to protrude from said body in both said open and said closed conditions, said body having live hinges interconnecting said grasping chambers, and said grasping chambers retaining the cartridges in both said open and said closed conditions; and a locking latch for latching said body in said closed condition for placement above a cylinder of a firearm with the cartridges protruding from said grasping chambers into chambers of the cylinder, said locking latch having a knob to be pulled with one hand for manually removing the body and releasing the cartridges in turn as the cylinder rotates and the cartridges drop fully into the chambers of the cylinder;

said body and said locking latch being formed in one piece.

2. The speed loader according to claim 1, wherein said given width is approximately one-half of the length of the cartridges.

3. The speed loader according to claim 1, wherein said body has fingers, said fingers have side walls and shoulders, pairs of said side walls of different fingers define said grasping chambers and pairs of said shoulders of different fingers between said chambers abut each other in said closed condition.

4. The speed loader according to claim 1, wherein said live hinges guide and maintain the cartridges in place and prevent misalignment.

5. The speed loader according to claim 4, wherein said live hinges are thinned sections of said body.

6. The speed loader according to claim 1, wherein said knob of said locking latch is disposed at one end of said body, said locking latch has a protrusion disposed at another end of said body, and said protrusion engages in a recess formed in the vicinity of said knob, in said closed condition.

7. The speed loader according to claim 1, wherein said body, in said closed condition, has an outer contour matching an outer contour of the cylinder of the firearm.

8. A method for loading a firearm, which comprises the following steps:

providing a flexible body having a flat open condition, a closed annular condition, grasping chambers interconnected by live hinges and a knob all in one piece;

loading cartridges into and retaining the cartridges in the grasping chambers of the body in the flat open condition, with the cartridges protruding from the grasping chambers;

placing and latching the body in the closed condition with the cartridges protruding from and retained in the grasping chambers;

placing the body in the closed condition above a cylinder of a firearm with the cartridges protruding into chambers of the cylinder; and pulling the knob with one hand to unlatch the body and release the cartridges in turn as the cylinder rotates and the cartridges drop fully into the chambers of the cylinder.

9. The method according to claim 8, wherein the body has a given width, and the cartridges have a length substantially greater than the given width.

10. The method according to claim 8, wherein the body has a given width, and the cartridges have a length substantially equal to twice the given width.

11. The method according to claim 8, wherein the body includes a locking latch having the knob.

12. The method according to claim 11, wherein the knob of the locking latch is disposed at one end of the body, the locking latch has a protrusion disposed at another end of the body, and the step of latching the body in the closed condition is carried out by engaging the protrusion in a recess formed in the vicinity of the knob.

13. The method according to claim 8, which further comprises guiding and maintaining the cartridges in place and preventing misalignment, with the live hinges located in the body between the grasping chambers.

14. The method according to claim 13, wherein the live hinges are thinned sections of the body.

15. The method according to claim 8, which further comprises providing the body with fingers, and limiting movement of the body into the closed condition by abutting pairs of shoulders of different fingers of the body between the chambers against each other.

16. The method according to claim 8, wherein the body in the closed condition, has an outer contour matching an outer contour of the cylinder of the firearm.

* * * * *